United States Patent [19]

Sagawa

[11] Patent Number: 4,624,580

[45] Date of Patent: Nov. 25, 1986

[54] TWISTING PENDULUM OPERATING APPARATUS

[75] Inventor: Hisaji Sagawa, Tokyo, Japan

[73] Assignee: Nisshindo Company, Ltd., Tokyo, Japan

[21] Appl. No.: 702,216

[22] Filed: Feb. 14, 1985

[30] Foreign Application Priority Data

Jun. 22, 1984 [JP] Japan ..... 59-93550[U]

[51] Int. Cl.[4] ..... G04B 15/00; G04B 19/00

[52] U.S. Cl. ..... 368/134; 368/223

[58] Field of Search ..... 368/76, 134–135, 368/179, 223, 243

[56] References Cited

U.S. PATENT DOCUMENTS 4,241,437 12/1980 Ashida ..... 368/134

4,378,166 3/1983 Itami et al. ..... 368/134

4,468,132 8/1984 Nakamura ..... 368/76

*Primary Examiner*—Vit W. Miska

*Attorney, Agent, or Firm*—Wenderoth, Lind & Ponack

[57] ABSTRACT

A twisting pendulum operating apparatus which includes a suspension wire for suspending a pendulum from a support, a rotary shaft which is engageable by gears of a clock for rotating the shaft about its longitudinal axis, a rotor fixed to the shaft, an idle wheel having protrusions along its outer circumference idly fitted to the shaft, permanent magnets on at least one of the idle wheel and the rotor, for magnetically urging the idle wheel to the rotor so that the idle wheel is rotated with the rotor and a connecting piece fixed to the suspension wire intermediate the opposite ends of the wire so as to releasably engage the protrusions, one-by-one, as the idle wheel rotates with rotation of the rotor, thereby to twist the suspension wire.

9 Claims, 5 Drawing Figures

TWISTING PENDULUM OPERATING APPARATUS

BACKGROUND OF THE INVENTION

1. Field of the Invention

This invention concerns an apparatus for operating a pendulum of a twisting pendulum clock.

2. Description of the Prior Art

Conventional clocks counted time by operating a pendulum, but today when clocks using battery cells, crystals, tuning forks, etc., are developed, the pendulum has become quite unnecessary, as far as the function of the clock is concerned.

Nevertheless, the pendulum has now been re-evaluated as a means of confirming that the clock is working or as a means of decoration, and many clocks operated by battery cells, etc., which are provided with a pendulum are being manufactured. One apparatus which operates the pendulum in such clocks has the following construction: A rotor having protrusions along its outer circumference is fixed securely to a rotary shaft which rotates using one of the operating gears of the clock; a pendulum is suspended from the clock-movement-fitting top frame by a suspension wire; a connecting piece is provided in the middle of this pendulum suspension wire, and made connectable to the protrusion of said rotor; the connecting piece which connects to this protrusion is caused to revolve by the protrusion of the rotor which rotates by the rotation of the rotary shaft, thereby twisting the suspension wire to rotate the pendulum. In such an apparatus, impact and strong resistance may be applied to the rotary shaft by way of said rotor due to resistance of the pendulum, impact applied to the rotor when the twisted pendulum returns to its original position, and stoppage of pendulum motion when external impact is applied to the clock. As a result, the function and accuracy of the clock are adversely affected, thereby sometimes causing trouble to the clock. Therefore, when pendulum resistance and impact due to twisting of the pendulum are applied to said rotor or when the pendulum stops its motion, it is necessary to cause the rotor to slip on the rotary shaft to buffer the resistance of the pendulum, impact, etc.

One conventional pendulum operating apparatus provided with a means to buffer such resistance, impact etc., has the following construction: A plate is fixed firmly to the rotary shaft; an idle wheel having protrusions along its outer circumference is idly fitted to said rotary shaft to cause the connecting piece to revolve; a spring is placed between the plate and the idle wheel, and its both ends are caused to come into contact with the plate and idle wheel elastically and under pressure; the rotation of the plate which rotates by the rotation of the rotary shaft is transferred to the idle wheel through frictional resistance of this spring, so that when said resistance, impact, etc., are applied to the idle wheel, the idle wheel is caused to slip and buffer the resistance and impact.

This conventional apparatus, however, poses various problems; namely, temperature changes cause changes in elastic pressure of the spring, and elastic pressure of the spring also becomes weaker due to aging changes in the spring arising from its long-term use; consequently, regular and satisfactory operations of the pendulum become unobtainable, the quality of clocks manufactured shows wide dispersion and clock assembling also becomes too complicated.

SUMMARY OF THE INVENTION

This invention has been made with a view toward solving the above-mentioned problems and is aimed at obtaining constant pendulum motions and facilitating pendulum manufacture.

In order to achieve said objectives, the present invention features that a laminar or cylindrical rotor is fixed securely to the rotary shaft which rotates using one of the operating gears of the clock, a laminar or cylindrical idle wheel having protrusions along its outer circumference is idly fitted to said rotary shaft to transfer the rotation of said rotor to the idle wheel by way of permanent magnets and a connecting piece provided in the middle of the pendulum suspension wire is made connectable to any one of the protrusions formed along the outer circumference of the idle wheel.

Further, when the rotor which is fixed securely to the rotary shaft rotates in keeping with the rotation of the rotary shaft which rotates by clock operation, the idle wheel which is fitted to the same rotary shaft rotates by the magnetic force of permanent magnets in synchronization with the rotation of the rotor. By the rotation of this idle wheel, the connecting piece which is connected to any one of the protrusions formed along the outer circumference of the idle wheel is rotated, and by this rotation of the connecting piece, the pendulum suspension wire is twisted to operate the pendulum. When pendulum resistance and impact of the returning pendulum are applied to the idle wheel, the rotation of the rotor is transferred to the idle wheel through permanent magnets by their magnetic force. Since the idle wheel and the rotor are not directly connected to each other, pendulum resistance and impact to the idle wheel are stopped by the idle wheel, and not transferred to the rotary shaft. Consequently, the function and accuracy of the clock are completely free of adverse effects of the pendulum resistance and impact.

DESCRIPTION OF THE PREFERRED EMBODIMENTS

The preferred embodiments of the present invention are explained below in detail by referring to the figures, but the present invention is not limited to the following preferred embodiments.

Figure 1:
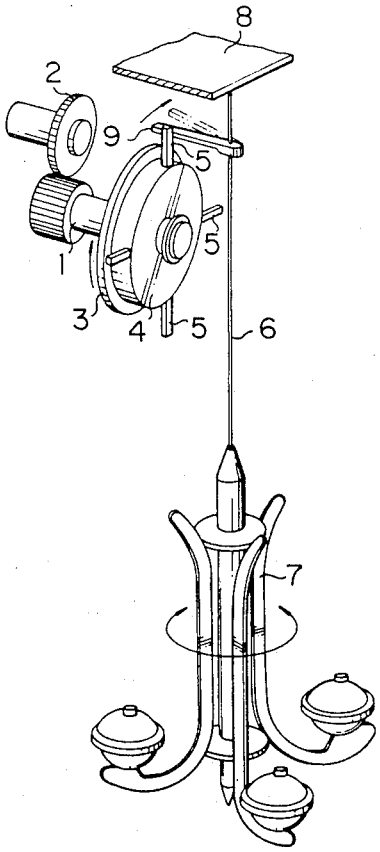
FIG. 1 is a front elevational view of a preferred embodiment of the present invention.
Figure 2:
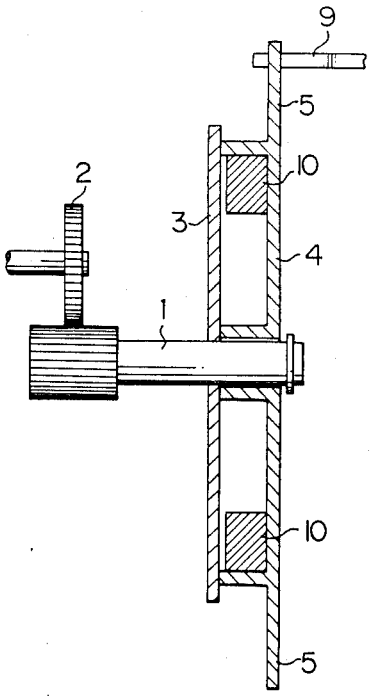
FIG. 2 is an enlarged sectional view of parts of the rotor and idle wheel in the embodiment of the present invention shown in FIG. 1, and FIGS. 3, 4, and 5 are sectional views respectively showing other preferred embodiments of the present invention.

FIG. 1 is a front elevational view showing a preferred embodiment of the present invention; FIG. 2 is a partial enlarged sectional view of FIG. 1. Reference numeral 1 designates a rotary shaft which rotates using one of the operating gears of the clock, and reference numeral 3 designates a rotor fixed securely to rotary shaft 1. Reference numeral 4 designates an idle wheel which is idly fitted to said rotary shaft 1, and protrusions 5 are formed along the outer circumference of the idle wheel 4 at appropriate intervals. Reference numeral 6 designates a pendulum suspension wire which suspends pendulum 7 at its bottom end and is fixed securely to clock-movement-fitting top frame 8 at its top end, and connecting piece 9 is provided in the middle of the pendulum suspension wire 6. This connecting piece 9 is made engagable with any one of the protrusions 5 of said idle wheel 4.

The rotor 3 is strongly magnetic and formed into a laminar shape, while idle wheel 4 is formed into a cylindrical shape and contains permanent magnets 10. Ordinarily, idle wheel 4 is held to rotor 3 by the magnetic force of permanent magnets 10 which are provided in idle wheel 4, so that the rotation of rotor 3 will be transferred to idle wheel 4 by way of permanent magnets 10. Here the magnetic force of permanent magnets 10 should be as strong as to be able to transfer the rotation of rotor 3 to idle wheel 4, but magnetic force above that intensity is not required.

Figure 3:
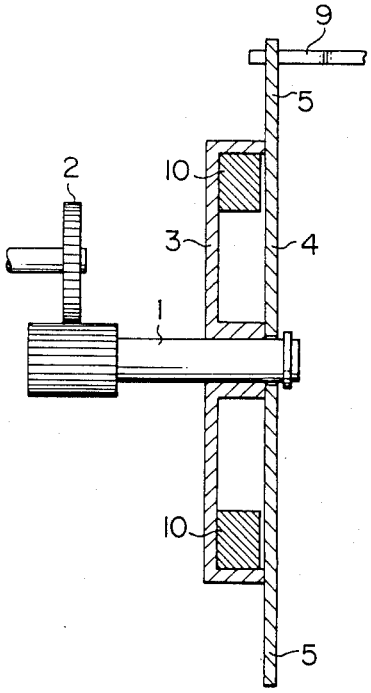

FIG. 3 shows another preferred embodiment of the present invention, in which idle wheel 4 is strongly magnetic and formed into a laminar shape, while rotor 3 is formed into a cylindrical shape and contains permanent magnets 10.

Figure 4:
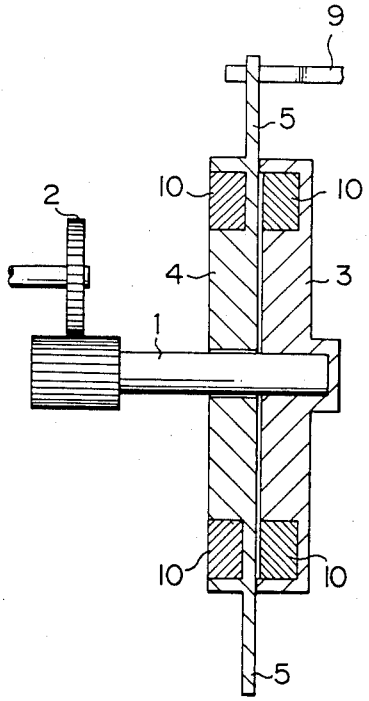

FIG. 4 shows another preferred embodiment, in which both rotor 3 and idle wheel 4 are respectively formed into cylindrical shapes, and permanent magnets 10 of different polarity are arranged in a facing position inside the respective cylinders.

Figure 5:
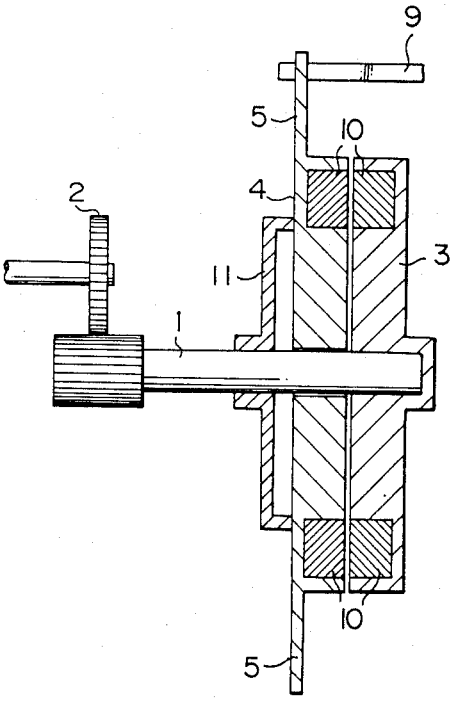

FIG. 5 also shows another preferred embodiment, in which both rotor 3 and idle wheel 4 are formed into cylindrical shapes, and permanent magnets 10 of identical polarity are arranged in a facing position inside the respective cylinders. Reference numeral 11 designates a rotor fixed to rotary shaft 1. It is arranged so that permanent magnets 10 provided in rotor 3 repels permanent magnets 10 provided in idle wheel 4, and this repelling force places idle wheel 4 and rotor 11 into contact under pressure. When rotor 11 rotates by the rotation of rotary shaft 1, idle wheel 4 which is in contact under pressure with the rotor 11 rotates in synchronization with the rotor 11 by frictional resistance.

The present invention is arranged so that a laminar or cylindrical rotor is fixed securely to the rotary shaft which rotates using one of the operating gears of the clock, and a laminar or cylindrical idle wheel having protrusions along its outer circumference is idly fitted to the rotary shaft, so that the rotation of said rotor will be transferred to the idle wheel by way of permanent magnets. Further, since a connecting piece which is provided in the middle of the pendulum suspension wire is made engagable with any one of protrusions formed along the outer circumference of the idle wheel, the rotation of the rotor accompanying that of the rotary shaft is transferred to the idle wheel by the magnet force of permanent magnets, so that the rotation of the connecting piece by any one of protrusions formed along the outer circumference of the idle wheel will operate the pendulum. On the other hand, when pendulum resistance, impact of the returning pendulum, etc., are applied to the idle wheel, the idle wheel buffers them and will not transfer their adverse effects to the rotary shaft, thereby completely obviating adverse effects on the function and accuracy of the clock.

It is also arranged that the rotation of said rotor is transferred to the idle wheel by the magnet force of permanent magnets. Since permanent magnets are not affected by temperature changes and develop no aging changes, they can continuously give regular operation to the pendulum, and since it is possible to obtain uniform magnetic force from permanent magnets used, no dispersion will occur in the quality of products and assembling work is easy.

I claim:

1. A twisting pendulum operating apparatus, comprising:

a suspension wire having a first end for being fixed to a support and a second end opposite said first end for being fixed to a pendulum, for suspending the pendulum from the support;

a rotary shaft having a longitudinal axis and having means for engaging the gears of a clock for rotating said shaft about said axis;

a rotor, fixedly secured to said shaft so as to rotate therewith;

an idle wheel having protrusions along an outer circumference thereof, idly fitted to said shaft;

means, including permanent magnets on at least one of said idle wheel and said rotor, for magnetically urging said idle wheel to said rotor such that said idle wheel is rotated with said rotor; and a connecting piece fixed to said suspension wire intermediate said first and second ends so as to be releasably engage said protrusions, one-by-one, as said idle wheel rotates with rotation of said rotor, thereby to twist said suspension wire.

2. A twisting pendulum operating apparatus as in claim 1, wherein said rotor and said idle wheel are circular in cross sections perpendicular to said axis.

3. A twisting pendulum operating apparatus as in claim 1, wherein said rotor is strongly magnetic and said permanent magnets are disposed in said idle wheel so that said idle wheel is magnetically attracted to said rotor.

4. A twisting pendulum operating apparatus as in claim 1, wherein said idle wheel is strongly magnetic and said permanent magnets are disposed in said rotor so that said idle wheel is magnetically attracted to said rotor.

5. A twisting pendulum operating apparatus as in claim 1, wherein said permanent magnets are disposed in both said rotor and said idle wheel.

6. A twisting pendulum operating apparatus, comprising:

a suspension wire having a first end for being fixed to a support and a second end opposite said first end for being fixed to a pendulum, for suspending the pendulum from the support;

a rotary shaft having a longitudinal axis and having means for engaging the gears of a clock for rotating said shaft about said axis;

a first rotor, fixedly secured to said shaft so as to rotate therewith;

a second rotor, fixedly secured to said shaft in axially spaced relation to said first rotor, so as to rotate with said shaft;

an idle wheel having portrusion along an outer circumference thereof, idly fitted to said shaft between said first and second rotors;

means, including permanent magnets on said idle wheel and said second rotor, for magnetically urging said idle wheel into frictional engagement with said first rotor such that said idle wheel is rotated with said first rotor; and a connecting piece fixed to said suspension wire intermediate said first and second ends so as to be releasably engage said protrusions, one-by-one, as said idle wheel rotates with rotation of said first rotor, thereby to twist said suspension wire.

7. A twisting pendulum operating apparatus as in claim 6, wherein said rotor and said idle wheel are circular in cross sections perpendicular to said axis.

8. A twisting pendulum operating apparatus, comprising:

a support;

a pendulum;

a suspension wire having a first end fixed to said support and a second end opposite said first end fixed to said pendulum so as to suspend said pendulum from said support;

a rotary shaft having a longitudinal axis and having means for engaging the gears of a clock for rotating said shaft about said axis;

a rotor, fixedly secured to said shaft so as to rotate therewith;

an idle wheel having protrusions along an outer circumference thereof, idly fitted to said shaft;

means, including permanent magnets on at least one of said idle wheel and said rotor, for magnetically urging said idle wheel to said rotor such that said idle wheel is rotated with said rotor; and a connecting piece fixed to said suspension wire intermediate said first and second ends so as to be releasably engage said protrusions, one-by-one, as said idle wheel rotates with rotation of said rotor, thereby to twist said suspension wire.

9. A twisting pendulum operating apparatus as in claim 8, wherein said first and second rotors and said idle wheel are circular in cross sections perpendicular to said axis.

* * * * *